US006628180B2

(12) United States Patent
Yim

(10) Patent No.: US 6,628,180 B2
(45) Date of Patent: Sep. 30, 2003

(54) DIELECTRIC FILTER HAVING COAXIAL RESONATORS AND A NOTCH PATTERN

(75) Inventor: Byoung-Jun Yim, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/901,692

(22) Filed: Jul. 11, 2001

(65) Prior Publication Data

US 2002/0180565 A1 Dec. 5, 2002

(30) Foreign Application Priority Data

May 30, 2001 (KR) ..... 01-30171

(51) Int. Cl.[7] ..... H01P 1/201
(52) U.S. Cl. ..... 333/202; 333/206
(58) Field of Search ..... 333/202, 206, 333/134

(56) References Cited

U.S. PATENT DOCUMENTS 5,406,236 A 4/1995 Newell et al.
5,949,310 A * 9/1999 Matsumoto et al. ..... 333/202
6,052,040 A * 4/2000 Hino ..... 333/134

FOREIGN PATENT DOCUMENTS

JP 405145302 A * 6/1993

* cited by examiner

*Primary Examiner*—Michael Tokar
*Assistant Examiner*—Vibol Tan
(74) *Attorney, Agent, or Firm*—Lowe Hauptman Gilman & Berner, LLP

(57) ABSTRACT

A dielectric filter having two outside resonators, one middle resonator disposed between the two outside resonators, and a notch pattern is provided. An input pad and an output pad are formed within respective non-coated lateral areas of a lateral surface corresponding to the outside resonators, respectively. The notch pattern is formed within an expanded non-coated lateral area of the lateral surface coupled to one of the non-coated lateral areas of the lateral surface which corresponds to a third position of the lateral surface corresponding to the middle resonator and one of the outside resonators. The notch filter is extended along the lateral surface from the input pad or the output pad toward the middle position corresponding to the middle resonator. The notch filter forms an electrical capacitor between the middle resonator and the input pad or the output pad.

8 Claims, 12 Drawing Sheets

DIELECTRIC FILTER HAVING COAXIAL RESONATORS AND A NOTCH PATTERN

BACKGROUND OF THE INVENTION

1. Field of the Invention

The present invention relates generally to a dielectric filter having a plurality of quarter wavelength type coaxial resonators and, more particularly, to a dielectric filter having a notch pattern for improving an attenuation characteristic of a high frequency band.

2. Description of the Related Art

Dielectric filters have been used for attenuating side frequency bands of a desired frequency band. Typically, the dielectric filters, such as a ceramic filter, include a dielectric block, which is made of a ceramic material, and a plurality of coaxial resonators formed in the dielectric block. Both a minimum insertion loss for the desired frequency band and an attenuation ratio for a side band of the desired frequency band should be accomplished in the dielectric filter. Moreover, the dielectric filter used in a device having a high frequency-band needs a more improved attenuation characteristic for the high frequency band, which is supposed to pass the dielectric filter. However, it is impossible that these conventional dielectric filters are minimized to be installed in a reduced size device because of the existence of an additional volume for a separate and individual notch hole formed in the dielectric filter.

FIGS 1A through 1C show a conventional dielectric filter, an equivalent circuit of the dielectric filter of FIG. 1A, and a diagram showing a representative characteristic of the dielectric filter of FIG. 1A. A dielectric filter 10 shown in FIG. 1A includes a dielectric block having an upper surface, a lower surface spaced-apart from and being parallel to the upper surface, and four walls perpendicular to both the upper surface and the lower surface. A plurality of coaxial resonators 10*a*, 10*b*, 10*c* includes respective through holes 11*a*, 11*b*, 11*c* formed in the dielectric block. A through hole 11*d* for a separate and individual notch hole is formed in the dielectric block parallel to and adjacent to one of the outside coaxial resonators 10*a*, 10*c* in order to provide the attenuation characteristic to the high frequency pass band. Through holes 11*a*, 11*b*, 11*c*, 111*d* are arranged along between the lateral surfaces in a series from one of side surfaces to the other one of the side surfaces.

A conductive material is coated onto the lower surface, the side walls, and an peripheral portion of the upper surface.

Respective coated upper areas 11-1, 11-2, 11-3, 11-4 as a loading capacitor pattern, coated with the conductive material are formed around the respective through holes 11*a*, 11*b*, 11*c*, 11*d* exposed on the upper surface of the dielectric block, and respective non-coated upper areas are formed between the coated peripheral portion of the upper surface and the coated upper areas of the resonators 10*a*, 10*b*, 10*c* and notch hole 10*d*.

An input pad 13*a* and an output pad 13*b* formed on one lateral side wall 22*a* are disposed adjacent to the upper surface to correspond to each of outside resonators. The input pad 13*a* and the output pad 13*b* are separated from the conductive material coated on the one lateral side wall 22*a* by non-coated lateral area 12*a* and non-coated lateral area 12*b*, respectively.

Non-coated lateral area 12*a* of lateral side wall 22*a* is coupled to non-coated upper area 14*a* of one of outside resonators 10*a*, 10*c* while the non-coated lateral area 12*b* of the one lateral side wall 22*a* is coupled to the non-coated upper area 14*c* of the other one of the outside resonators 10*a*, 10*b*, 10*c*, 10*d*.

An equivalent circuit of the dielectric filter of FIG 1A is shown in FIG 1B. In and out represent the input pad 13*a* and the output pad 13*b*. NR is defined by a diameter and a length of the notch hole. CN1 is defined by a distance between the loading capacitor pattern and the input and output pads while CN2 is defined by a distance between the loading capacitor pattern of the notch hole and the peripheral coated portion of the upper surface. FIG 1C shows reflection loss S11 and propagation characteristics or attenuation characteristics S21 of dielectric filter 10. An insertion loss P1 of the high frequency band is formed, and an attenuation pole AP of the high frequency band is established.

The conventional dielectric filters, however, are prevented from being reduced in size because the dielectric filters must be provided with additional volume for the notch hole. The conventional dielectric filters are relatively bulky in size compared to the minimized device which is installed with the dielectric filter 10. Therefore, I have found that the conventional dielectric filters are not reduced in size and that it is difficult and often inconvenient to install the conventional dielectric filter into the relatively small device in consideration of the recently developed minimized device.

SUMMARY OF THE INVENTION

It is an object to provide an improved dielectric filter having a plurality of resonators and input and output pads constructed according to the principles of the present invention.

It is another object to provide improved dielectric filter able to be reduced in size and to exhibit improved attenuation characteristics of a desired high frequency pass band.

It is yet another object to provide an improved dielectric filter able to remove a notch hole occupying an additional space in the dielectric filter.

It is still another object to provide an improved dielectric filter able to be mounted in a relatively small device which is installed with the dielectric filter.

It is a further object to provide an improved dielectric filter able to reduce a manufacturing cost.

It is also object to provide an improved dielectric filter able to shorten a manufacturing process.

These and other objects may be achieved by providing an improved dielectric filter having a notch pattern constructed according to the principles of the present invention. The dielectric filter includes a dielectric block, such as a dielectric ceramic block, defining an upper surface, a lower surface spaced apart from and being to the upper surface, two longitudinal lateral surfaces each spaced apart form each other and being parallel to both the upper surface and the lower surface, and two side surfaces disposed between the lateral surfaces and being perpendicular to the lateral surfaces. The lateral surfaces and the side surfaces form peripheral sides of the dielectric block between the upper surface and the lower surface. The lateral surfaces, the side surfaces, the lower surface, and a peripheral outside area of the upper surface are coated with a conductive material. Three resonators, such as first and second outside resonators and a middle resonator disposed between the outside resonators, includes through holes formed in the dielectric block, being parallel to each other, arranged between the lateral surfaces from one of the side surfaces toward the other one of the side surfaces in a series, and having respective openings exposed on the upper surface.

The conductive material is coated on each peripheral inner wall of the through holes. Also, the conductive material is coated around each opening of the through holes to form coated upper areas in order to provide a loading capacitance pattern to respective resonators. The coated upper areas are connected to the conductive material coated on the peripheral inner wall of the through holes. Non-coated upper area is formed around each of the coated upper areas of the resonators and between the peripheral outside area and each of the coated upper areas of the resonators.

Two non-coated lateral areas are formed on one of the lateral surfaces adjacent to the upper surface and coupled to the respective non-coated upper area of the upper surface. An input pad and an output pad are disposed within each of the non-coated lateral area of the lateral surface at a first position corresponding to the first resonator and a second position corresponding to the second resonator, respectively. The input pad and the output pad are spaced-apart from the conductive material coated on the lateral surface and to be electrically coupled to the first resonator and the second resonator, respectively, through the respective non-coated lateral areas of the lateral surface and the non-coated upper area of the upper surfaces.

One of the two non-coated lateral areas of lateral surface is continuously expanded along the lateral surface toward the other one of the two non-coated lateral areas, and one end of the expanded non-coated lateral area is disposed on a third position of the lateral surface corresponding to the middle resonators in order to provide a capacitance between the input pad and the middle resonator. The extended non-coated lateral area is separated from the non-coated upper area of the middle resonator by a conductive material covering between the extended non-coated lateral area of the lateral surface and the non-coated upper area of the upper surface.

The notch pattern made of the conductive material and disposed within both the non-coated lateral area and the extended non-coated lateral area of the one of the lateral surfaces is continuously extended from the input pad toward a middle position corresponding to the middle through hole of the middle resonator along the lateral surface in a direction parallel to the upper surface in order to provide a capacity coupling between the middle resonator and the input pad.

With the existence of the notch pattern, an electric field is formed between the middle resonator and the input or output pad. Since the attenuation pole is formed on a desired high frequency band in accordance with the capacitance equivalent to the electric field formed between the input pad and the middle resonator, the attenuation characteristic is established in the desired high frequency band.

BRIEF DESCRIPTION OF THE DRAWINGS

A more complete appreciation of the invention, and many of the attendant advantages, thereof, will be apparent as the same becomes better understood by reference to the following detailed description when considered in conjunction with the accompanying drawings in which like reference symbols indicate the same or similar components, wherein.

DESCRIPTION OF THE INVENTION

Figure 2A:
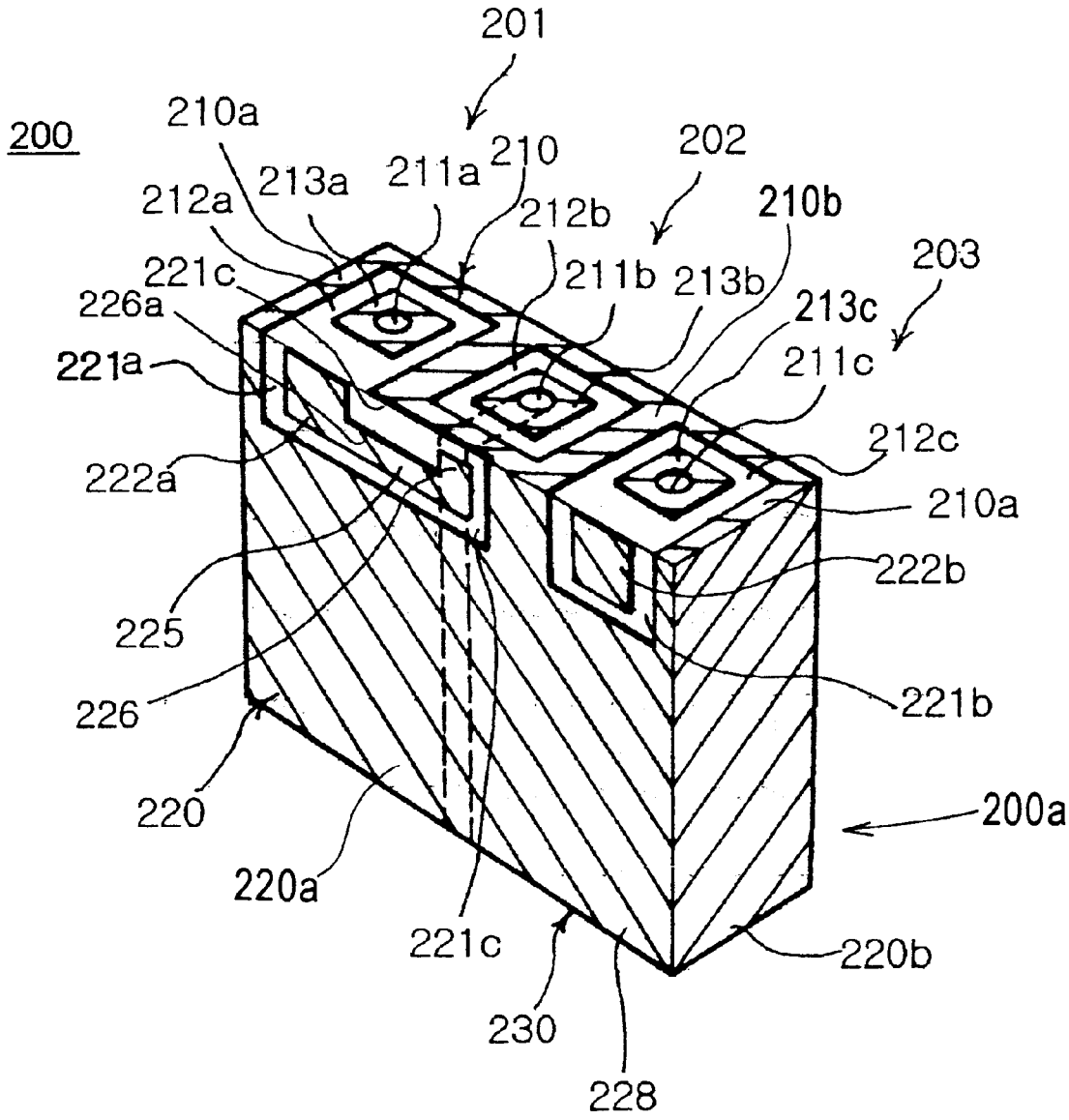
FIG. 2A is a perspective view of a dielectric filter having a notch pattern constructed according to the principles of the present invention.

Turning now to the drawings, FIG. 2A shows a dielectric filter 200 including a dielectric block 200*a* defining an upper surface 210, a lower surface 230 spaced-apart from upper surface 210, two lateral surfaces 220*a* and two side walls 220*b* spaced- apart from each other and perpendicular to upper surface 210 and lower surface 230 so as to form a peripheral side 220 of dielectric block 200*a*. A conductive material is coated on a peripheral upper area 210*a* of upper surface 210, lower surface 230, two lateral surfaces, and two side walls 220 in order to form an outer conductor 228 operating as a shield or ground electrode.

The dielectric filter 200 is provided with two outside resonators 201, 203 and a middle resonator 202 having respective through holes 211*a*, 211*c*, 211*b* formed in dielectric block 200*a*, arranged between lateral surfaces 220*a* from one of side surfaces 220*b* toward the other one of side surfaces 220*b* in a series, being parallel to each other, and having respective openings exposed on upper surface 210. The conductive material is coated on each peripheral inner wall of through holes 211*a*, 211*b*, 211*c*. Coated upper areas 213*a*, 213*b*, 213*c* coated with the conductive material are formed around each opening of through holes 211*a*, 211*b*, 211*c* and coupled to the conductive material coated on the peripheral inner wall of through holes 211*a*, 211*b*, 211*c* in order to provide a pattern for loading capacitance to respective resonators 201, 202, 203. Non-coated upper portions 212*a*, 212*b*, 212*c* are formed around the each of coated upper areas 213*a*, 213*b*, 213*c* of resonators 201, 202, 203 and between the peripheral outside area 210*a* and each of coated upper areas 213*a*, 213*b*, 213*c* of resonators 201, 202, 203. A second conductive upper area 210*b* is formed around non-coated upper area 212*b* of middle resonator 202.

Two non-coated lateral areas 221*a*, 221*b* are formed on a lateral surface 220*a* adjacent to upper surface 210 and coupled to respective non-coated upper area.s 212*a*, 212*c* of upper surface 210. An input pad 222*a* and an output pad 222*b* are disposed within each of the non-coated lateral areas 221*a*, 221*b* of lateral surface 220*a* at a first position of lateral surface 220*a* corresponding to first outside resonator 201 and a second position of lateral surface 220*a* corresponding to second outside resonator 203, respectively. Input pad 222*a* and non-coated lateral area 221*a* is spaced-apart from outside pad 222*b* and non-coated lateral area 221*b* by the conductive material coated on lateral surface 220*a*. Input pad 222*a* is electrically coupled to first outside resonator 201 through non-coated lateral area 221*a* of lateral surface 220*a* and non-coated upper area 212*a* of upper surface 210, and output pad 222*b* is electrically coupled to second outside resonator 203 through both non-coated lateral area 221*c* of lateral surface 220*a* and non-coated upper area 212*c* of upper surface 210.

An extended non-coated lateral area 221 c of non-coated lateral area 221*a* of lateral surface 220*a* is continuously expanded from non-coated lateral area 221*a* of lateral surface 220*a* along lateral surface 220*a* toward non-coated lateral area 221*b*, and one end of extended non-coated lateral area 221*c* is disposed on a third position of lateral surface 220*a* between middle resonator 202 and second outside resonator 203 in order to provide a capacitance between input pad 222*a* and middle resonator 202. Extended non-coated lateral area 221*c* is separated from non-coated upper area 212*b* of middle resonator 202 by second conductive coated upper area 210*b* disposed between extended non-coated lateral area 221 c of lateral surface 220*a* and non-coated upper area 212*b* of upper surface 210.

A notch pattern 225 made of the conductive material is disposed within non-coated lateral area 221*a* and extended non-coated lateral area 221*c* of lateral surface 220*a*. an extended pad 225*a*, of notch pattern 225 is continuously extended from input pad 222*a* toward a third middle corresponding to through hole 211*b* of middle resonator 202 along lateral surface 220*a* in a direction parallel to upper surface 210, and end portion 226 is disposed on third position corresponding to through hole 211*b* of middle resonator 202 in order to form a capacity coupling between middle resonator 202 and input pad 222*a*. Extended pad 225*a* and input pad 222*a* are integrally made in a monolithic structure. Broken lines show a relationship between through hole 211*b* of middle resonator 202 and notch pattern 225 both overlapped in front view of lateral surface of dielectric filter 200.

Figure 2B:
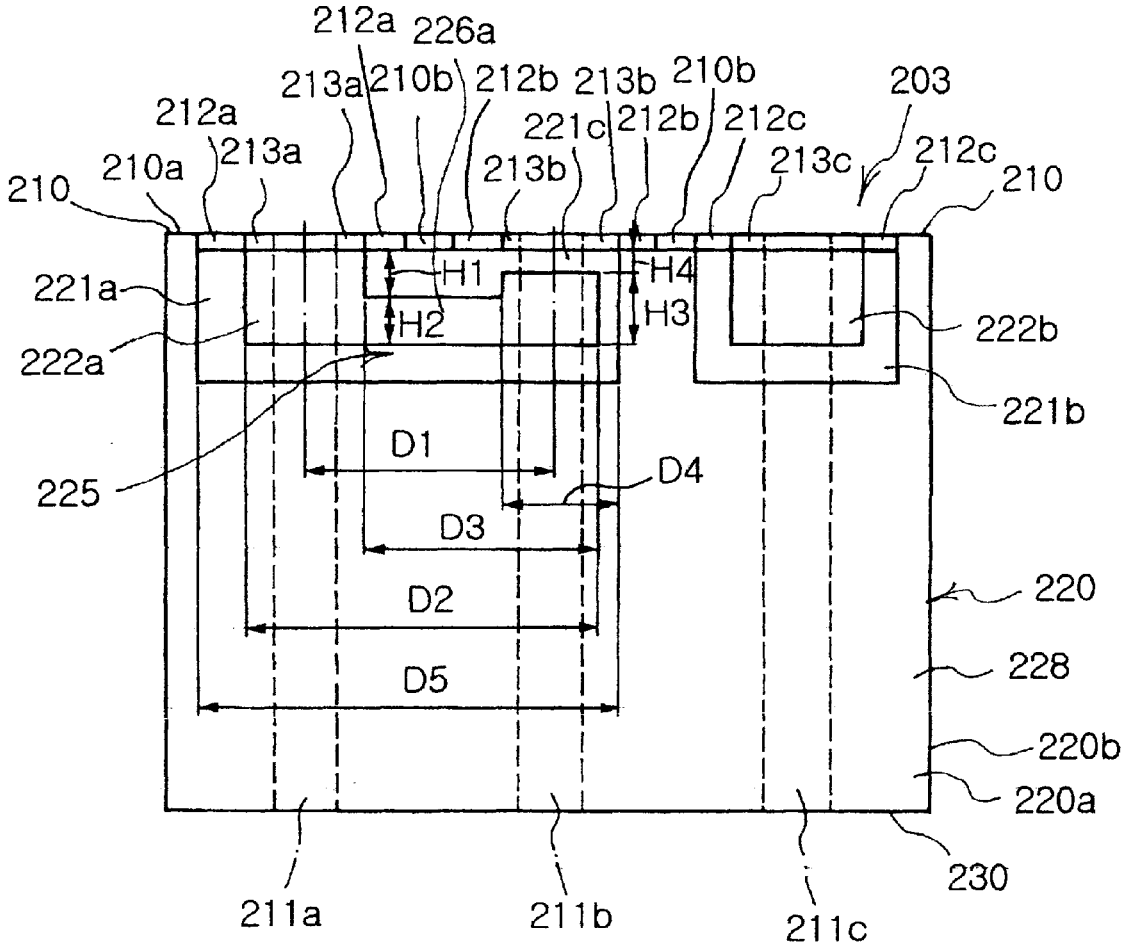
FIG. 2B is a front view of a lateral surface of the dielectric filter of FIG. 2A.

As shown in FIG. 2B, a numeral D1 denotes a first distance between central axes of first and middle through holes 211*a*, 211*b*. A second length D2 of input pad 221*a* and notch pattern 225 is greater than first distance D1 between the axes of through holes 211*a*, 211*b* of first outside resonator 201 and middle resonator 202. Extended pad 225*a* of notch pattern 225 is spaced-apart from upper surface 210 by a first height HI and has a second uniform thickness H2, and an end portion. 226 of notch pattern 225 has a third thickness H3 greater than second thickness H2 of extended pad 225*a*. Third thickness H3 of end portion 226 of notch pattern 225 may be equal to second thickness H2 of extended pad 225*a*. End portion 226 is spaced apart from upper surface 210 by a fourth thickness H4 which may be equal to or less than third thickness H3 of end portion 226 or first thickness HI between extended pad 225*a* and upper surface 210. Extended pad 225*a* has a fifth length D5 being less or greater than or equal to fourth length D4 of end portion 226. Third length D3 of notch pattern 225 is less than second length D2. Fourth length D4 of end portion 226 may be equal to third length D3 of extended pad 225*a*.

Figure 2C:
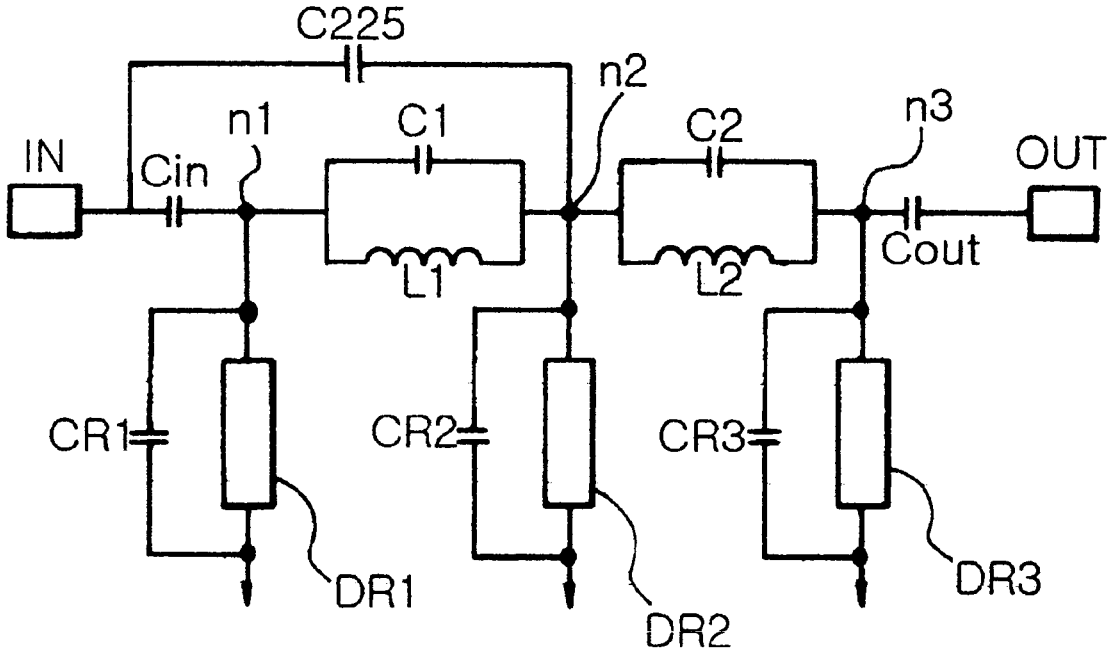
FIG. 2C is a diagram showing an equivalent circuit of the dielectric filter of FIG. 2A.

FIG. 2C shows an equivalent circuit diagram of the dielectric filter of FIG. 2A. Terminals IN and OUT represent input pad 222*a* and output pad 222*b*. A capacitor Cin is defined by a distance between input pad 222*a* and outer resonator 201 while a capacitor C out is defined by a distance between output pad 222*b* and outer resonator 203. Each inductance DR 1, DR2, DR3 coupled to each node n1, n2, n3 is defined by a length and a diameter of respective through holes 211*a*, 211*b*, 211*c*. Each capacitance CR1, CR2, CR3 is a function of both a distance between outer conductor 228 and each of loading capacitor patterns 213*a*, 213*b*, 213*c* of resonators 201, 202, 203. Reference characters C1 , C2 denote an equivalent capacitance of an electric field formed between resonators 201, 202, 203.

Each inductance L1, L2 is defined by an equivalent inductance of a magnetic field formed between resonator 201, 202, 203.

Capacitor C225 coupled between node n2 and terminal IN of input pad 222*a* is defined by an equivalent electric field formed between middle resonator 202 and input pad 222*a* in response to notch pattern 225. If notch pattern 225 is coupled to output pad 222*b*, capacitor C225 is coupled between node 2 and terminal OUT of output pad 222*b*. Capacitor C225 coupled between node n2 and terminal output of output pad 222*b* is defined, by an equivalent electric field formed between middle resonator 202 and output pad 222*b* in response to notch pattern 225.

Figure 1A:
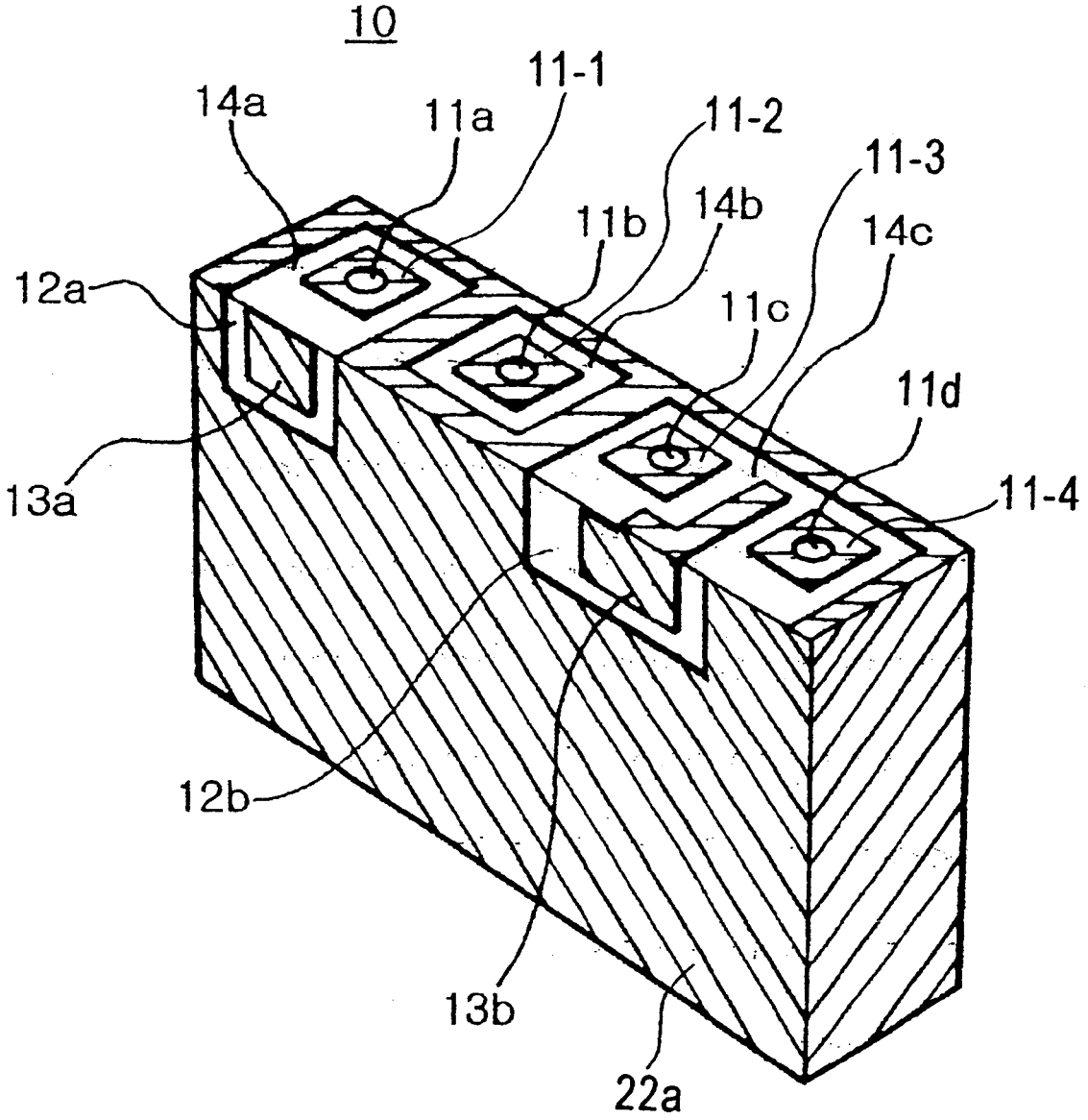
PRIOR ART FIG. 1A
FIG. 1A is a perspective view of a dielectric filter.
Figure 1B:
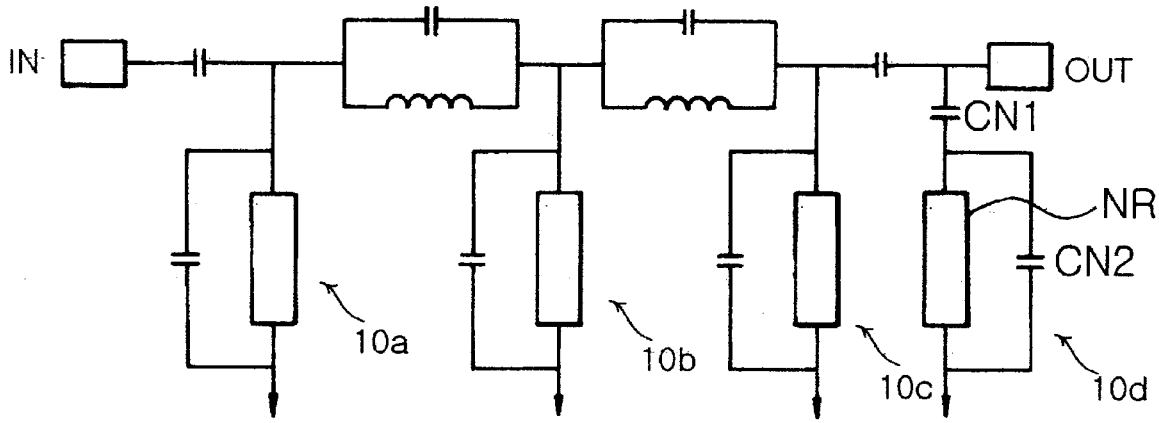
PRIOR ART FIG. 1B
FIG. 1B is a diagram showing an equivalent circuit of the coaxial resonator of FIG. 1A.
Figure 1C:
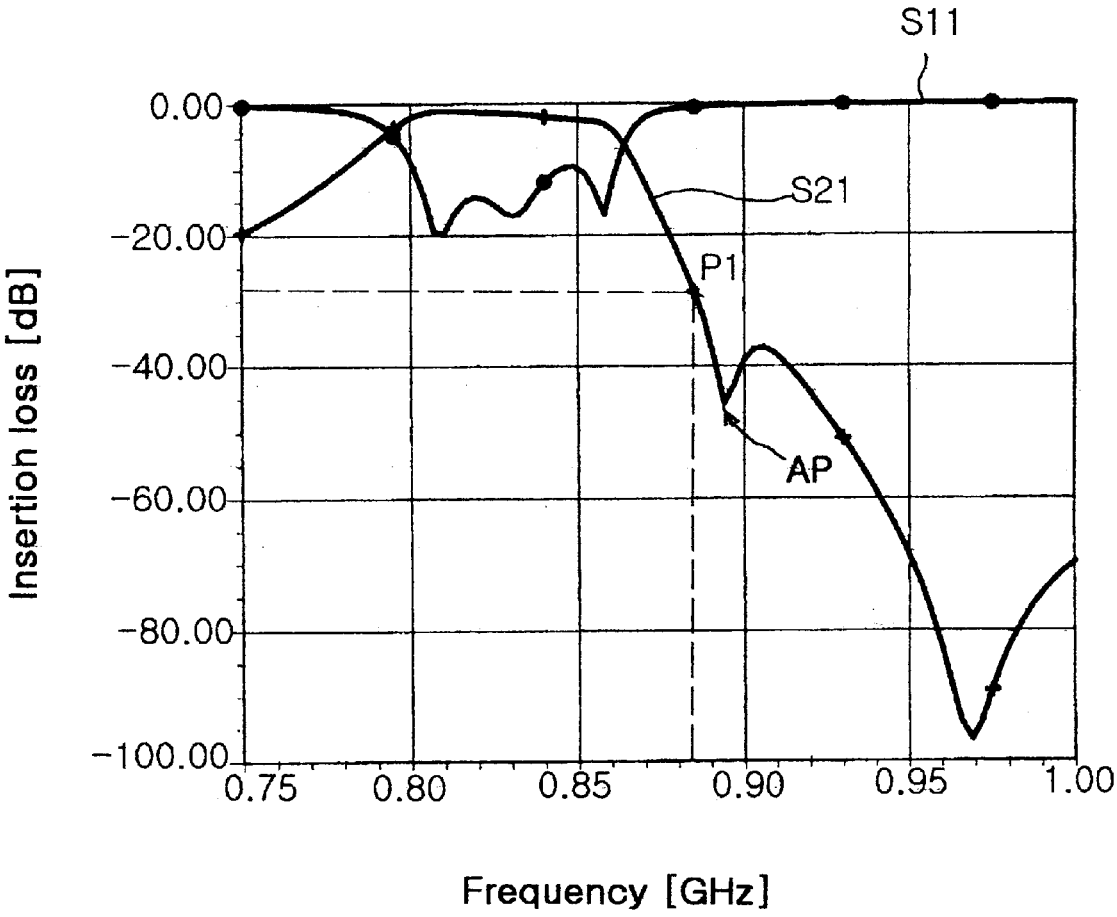
PRIOR ART FIG. 1C
FIG. 1C is a diagram showing representative frequency propagation characteristics of the dielectric filter of FIG. 1A.
Figure 2D:
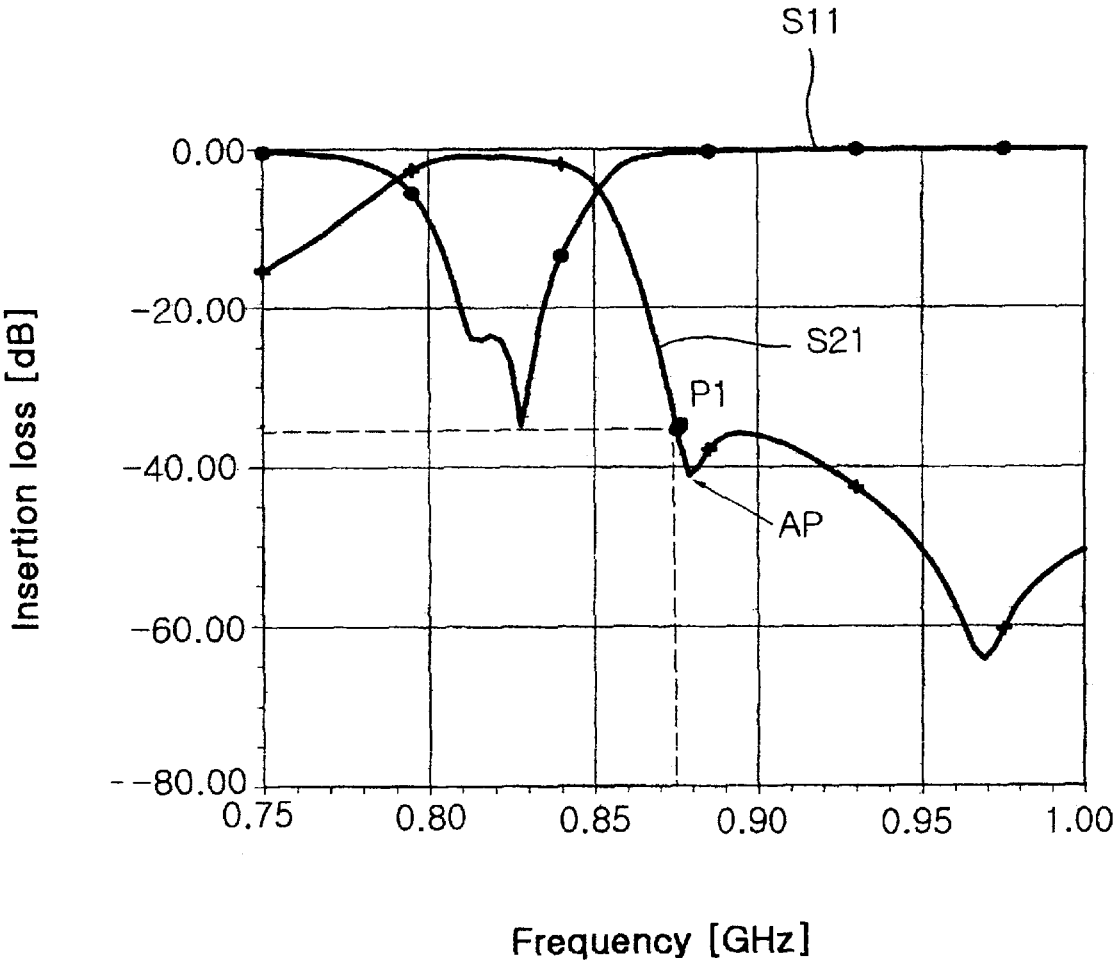
FIG. 2D is a diagram showing representative frequency propagation characteristics of the dielectric filter of FIG. 2A.

In FIG. 2D, attenuation pole AP is established in high frequency pass band in response to both middle resonator 202 and the equivalent capacitance of the electric field formed between middle resonator 202 and notch pattern 225 coupled to input pad 222*a*. A desirable insertion loss and attenuation ratio are formed around a position P1 of a high frequency pass band in response to the existence of attenuation pole AP. The insertion loss of the position P1 is relatively lowered compared to the insertion loss P1 of FIG 1C.

As described above, a more desirable attenuation characteristic of the, high frequency pass band is established by notch pattern 225 constructed according to the principles of the present invention and is illustrated in FIG. 2D obtained by repeated experiments. For example, notch pattern 225 may be extended from input pad 222*a* or separately spaced-apart from input pad 222*a*. Extended input pad 225*a* may have uniform or non-uniform height and may be a linear type or non linear type. The shape of notch pattern 225 varies depending on the desired attenuation pole and the insertion loss of the high frequency pass bend of dielectric filter 200.

Figure 3A:
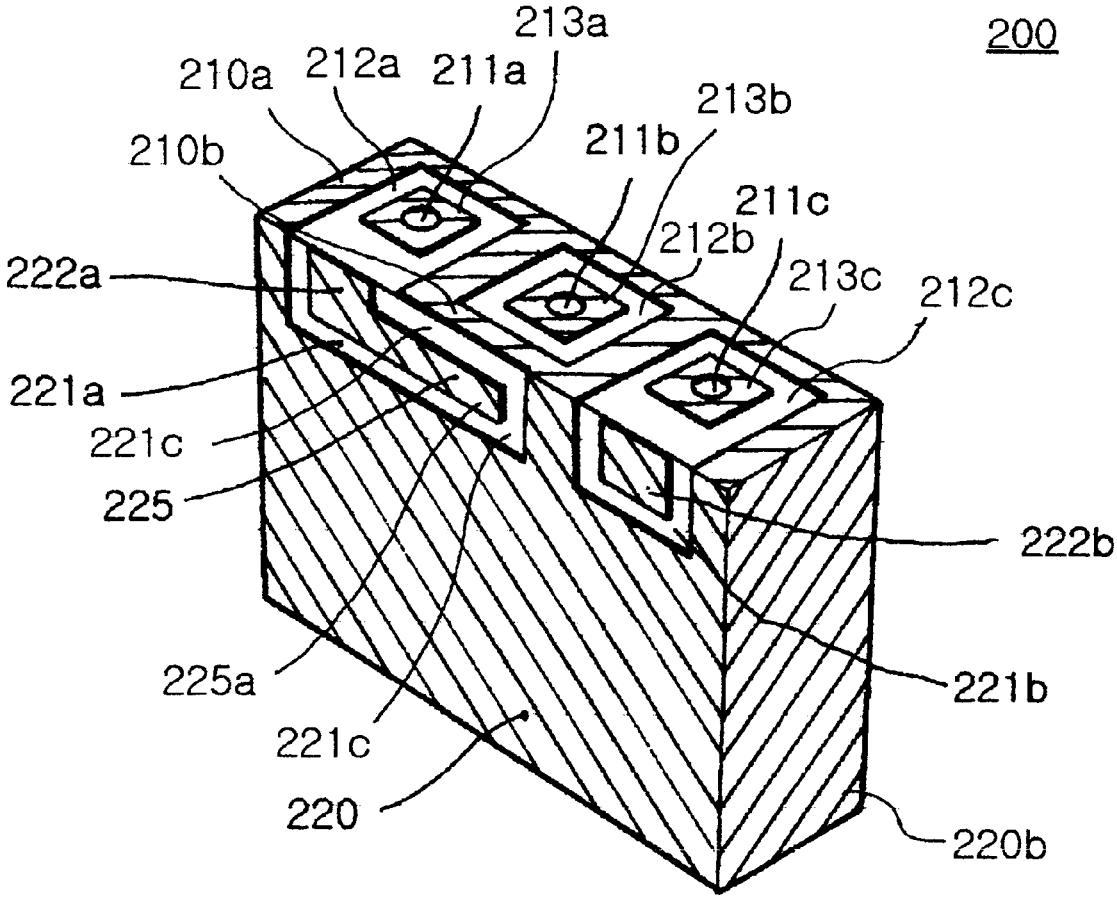
FIGS. 3A and 3B are perspective views of a second embodiment constructed according to the principles of the present invention.

FIG. 3A shows a second embodiment of dielectric filter 200 constructed according to the principles of the present invention. Non-coated lateral area 221*a* is expanded along lateral surface 220*a* toward the corresponding third position between middle resonator 202 and second outside resonator 203. Extended pad 225*a* is extended within both non-coated lateral area 221*a* and expanded non-coated area 221*c* along lateral surface 220*a* from input pad 222*a* toward middle position corresponding to. through hole 211*b* of middle resonator 202. In a front view of lateral surface 220*a* of dielectric filter, notch pattern 225 is overlapped with through hole 211*b* of middle resonator 202.

Figure 3B:
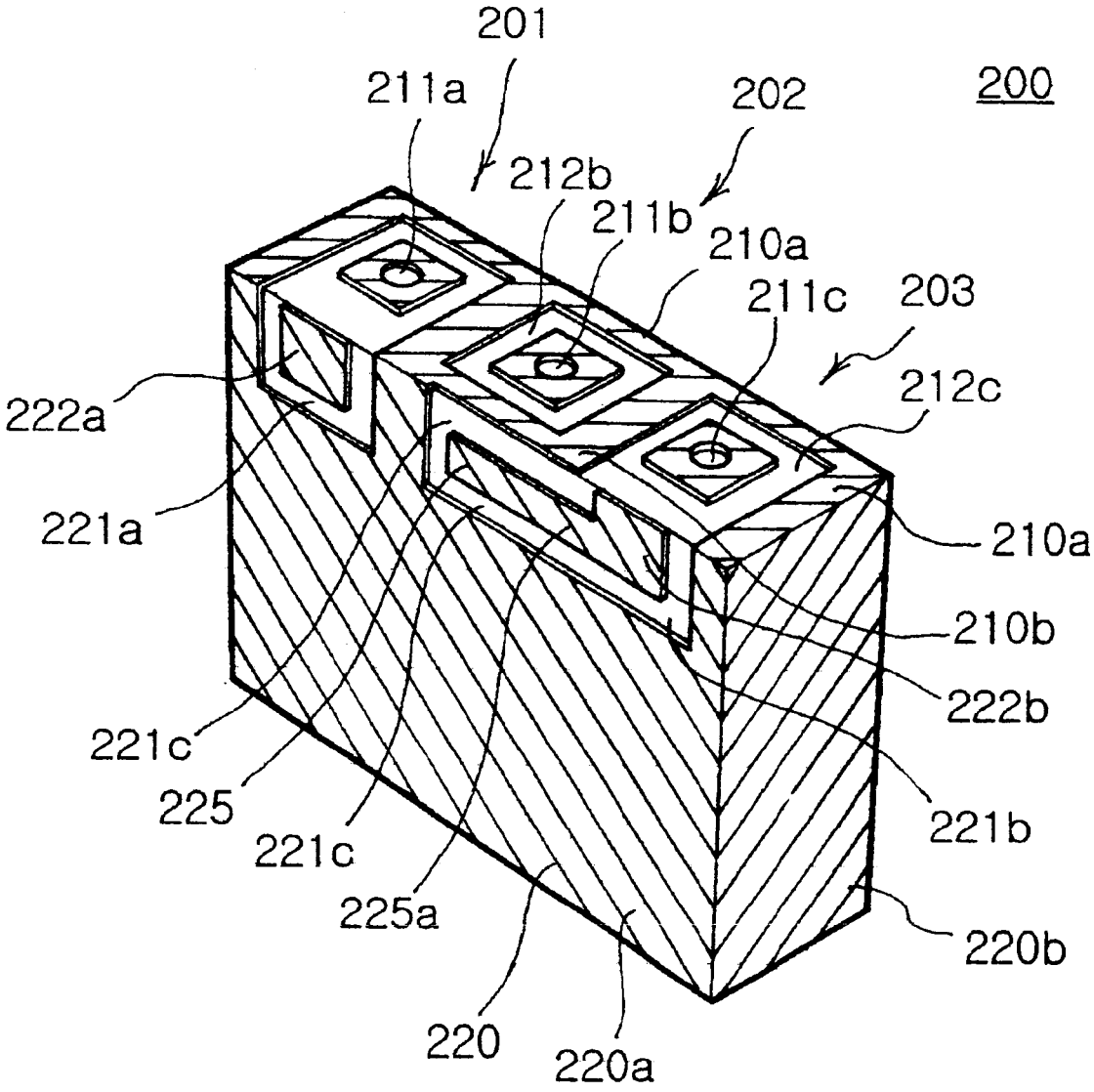

A capacitance is formed between notch pattern 225 coupled to input pad 222*a* and loading capacitor pattern 213*b* formed around the opening of through hole 211*a* of middle resonator 202 in upper surface 210. As described above, the second embodiment of dielectric filter 200 includes notch pattern 225 having extended pad 225*a* which is extended from input pad 221*a*. Extended pad 225*a* may be extended from output pad 222*b* disposed within expanded non-coated lateral area 222*c* of lateral surface 220*a* as shown in FIG. 3B.

Figure 4:
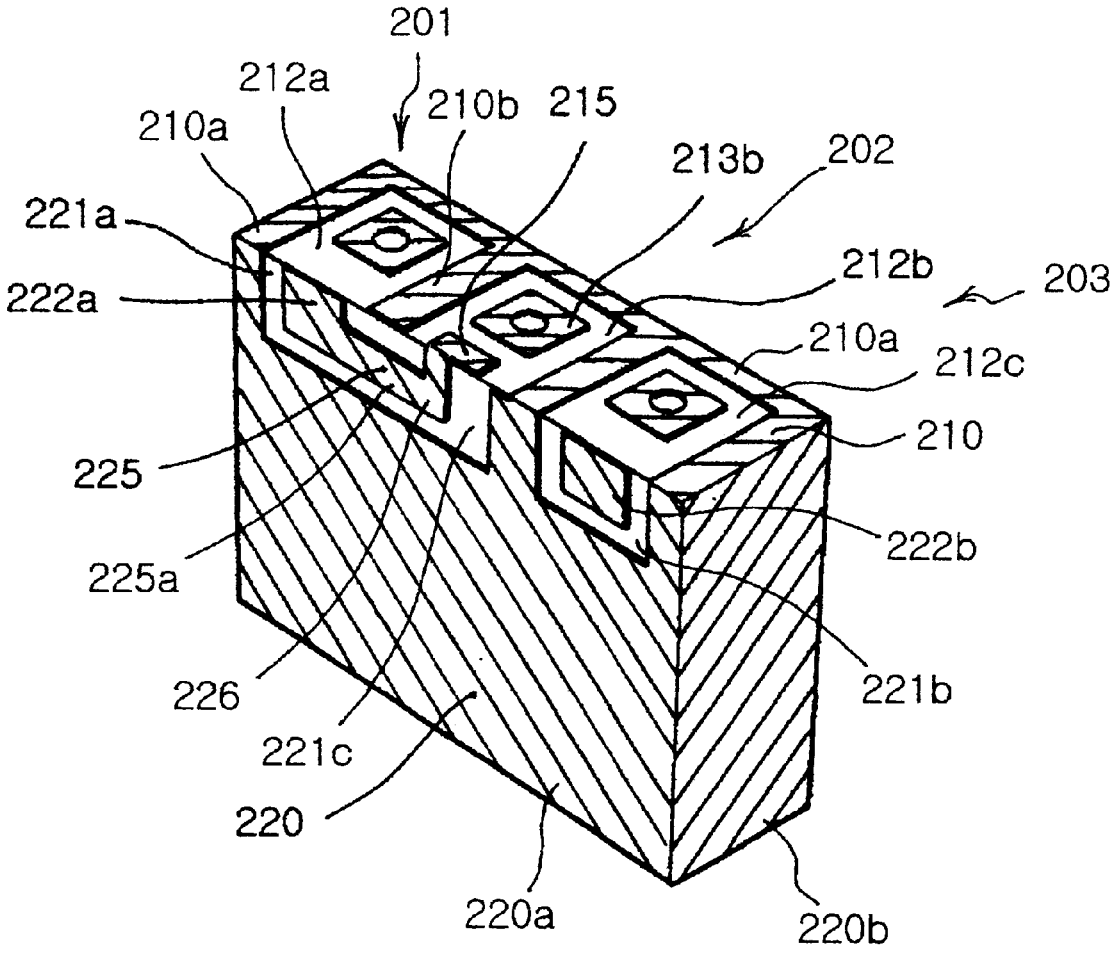
FIG. 4 is a perspective view of a third embodiment constructed according to the principles of the present invention.
Figure 5:
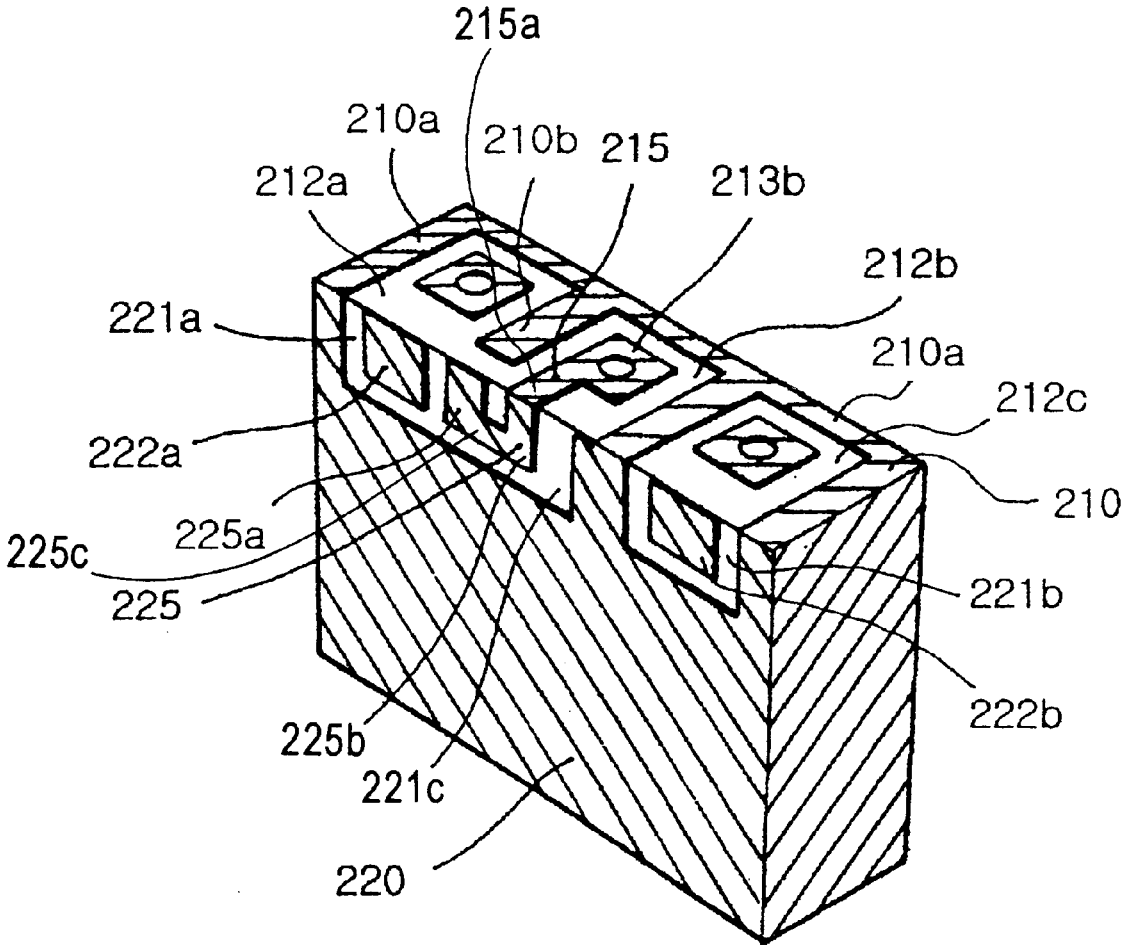
FIG. 5 is a perspective view of a fourth embodiment constructed according to the principles of the present invention.

In FIGS. 4 and 5, a sub-notch pattern 215 extended from main notch pattern 225 and input pad 222*a* and disposed on non-coated upper area 212*b* may be coupled to the loading capacitor pattern of coated upper area 213*b* of middle resonators 202 and may be spaced-apart from the loading capacitor pattern of coated upper area 212*b* of middle resonators 202 by a predetermined distance. Sub-notch pattern 215 is placed on upper surface 210 while input pad 222*a* and notch pattern 225 are disposed on lateral surface 220*a*.

FIG. 4 shows a third embodiment constructed according to the principles of the present invention. Expanded non-coated lateral surface 221*c* is coupled to non-coated upper area without discontinuity. Sub-notch pattern 215 is extended from end portion 226 and extended pad 225*a* of notch pattern 225 and is disposed within non-coated upper area 212*b* of upper surface 210. Extended pad 225*a* has a predetermined length and a predetermined height while end portion 226 of notch pattern 225 has a length and a height different from or greater than the extended input pad 225*a*.

Sub-notch pattern 215 is additionally extended from end portion 226 of notch pattern 225 to non-coated upper area 212*b* which is expanded toward and coupled to expanded non-coated lateral area 221*c*. Non-coated upper area 212*b* is expanded toward and coupled to expanded non-coated lateral area 221*c*.

The conductive material is coated on sub-notch pattern 215, end portion 226, extended input pad 225*a*, and input pad 222*a* without discontinuity and is spaced-apart from loading capacitor pattern 213*b* of middle resonator 202 within upper surface 210.

As shown in FIG. 5, notch pattern 225 is spaced-apart from input pad 222*a* by non-coated lateral area 221*a*. Both end portions 225*a*, 225*b* of notch pattern 225 have a height greater than a middle portion 225*c* coupled between end portions 225*a*, 225*b*. Non-coated upper area 212*b* is expanded toward and coupled to expanded non-coated lateral area 221*c*. Sub-notch pattern 215*a* extended from one end portion 225*a* of notch pattern 225 is disposed on non-coated upper area 212*b* to be coupled to loading capacitor pattern of coated upper area 213*b* disposed on upper surface 210 through non-coated upper area 212*b*. The conductive material is coated on middle portion 225*c*, end portions 225*a*, 225*b*, sub-notch pattern 215, and loading capacitor pattern 213*b* of middle resonator 202 without discontinuity. Notch pattern 225 is spaced-apart from input pad 222*a* and is coupled to loading capacitor pattern 213*b* of middle resonator 202. Capacitance C225 is defined by both a shape of notch pattern 225 and a distance between input pad 222*a* and notch pattern 225.

Figure 6:
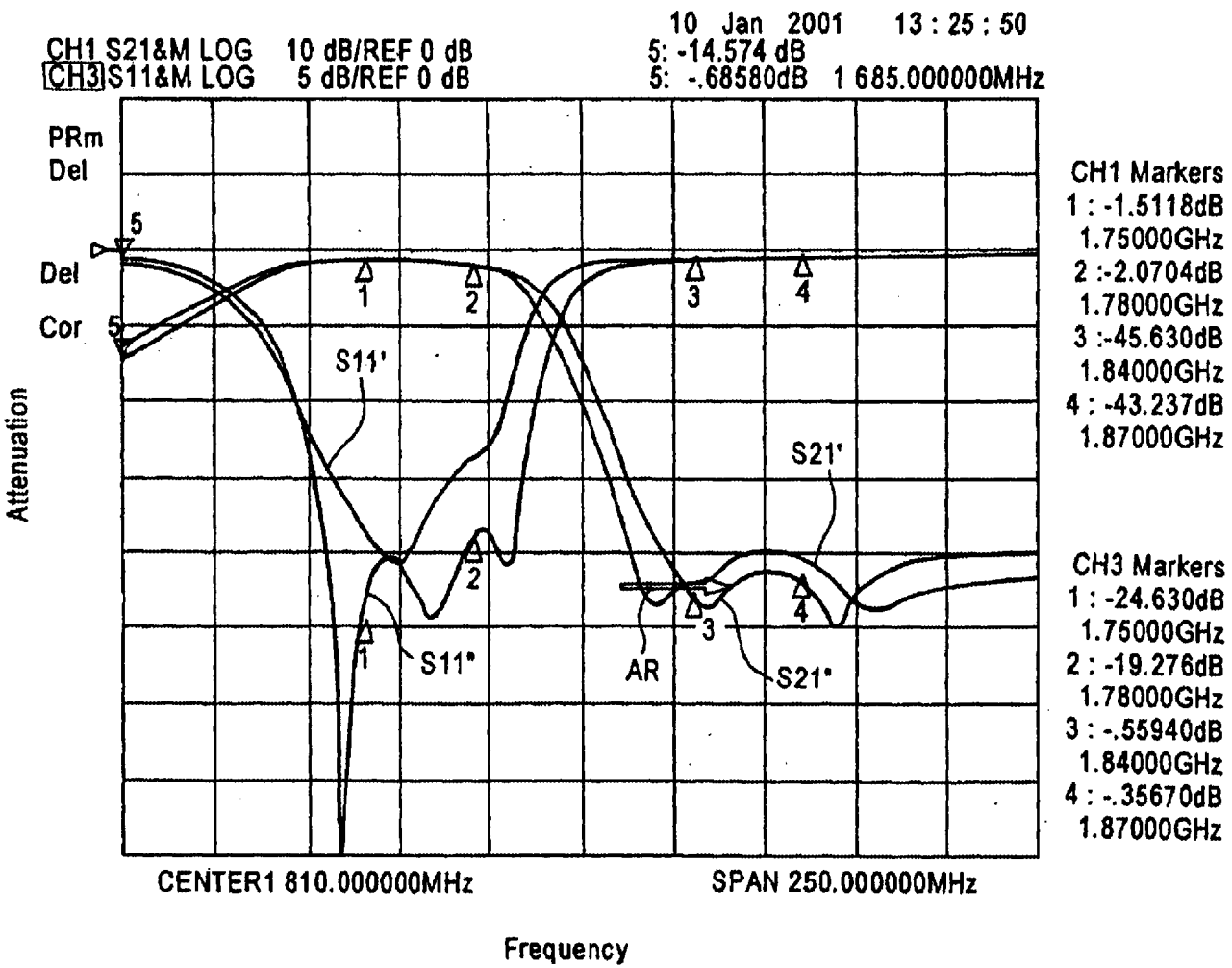
FIG. 6 is a diagram showing both movement of the attenuation frequency and the representative propagation characteristics of the dielectric filter constructed according to the present invention.

FIG. 6 is a diagram showing frequency response characteristics for attenuation pole AP of dielectric filter constructed according to the principles of the present invention. With the existence of the notch pattern, an electric field is formed between the middle resonator and the input or output pad disposed within the non-coated lateral area of the lateral surface. Since the attenuation pole is formed on a desired high frequency band in accordance with the capacitance equivalent to the electric field formed between the input pad and the middle resonator, the attenuation characteristic is established in the desired high frequency band. Attenuation pole AP may be adjusted in response to middle resonator 202 and capacitance of the electric field formed by an area of notch pattern 225 and a distance between loading capacitor pattern 213*b* and notch pattern 225. A pair of graphs S11', S11" show frequency characteristics before and after capacitance C225 and resonator frequency are tuned. A pair of graphs S21', S21" show frequency characteristics shifted to a high frequency pass band in a direction AR in response to adjustment of capacitance C225.

As described above, according to the principles of the present invention, it is very advantageous that the dielectric filter is provided with notch pattern formed on a lateral surface of a dielectric block because the notch pattern provides direct capacitor coupling between the middle resonator and the input or output pad. With the notch pattern formed on the same lateral surface as the outer conductor, the conventional notch hole is removed. Moreover, the size of the dielectric filter is reduced. Furthermore, a more desirable attenuation characteristic of the frequency pass band is established without the conventional notch hole.

This invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A dielectric filter, comprising;

a dielectric block defining an upper surface, a lower surface spaced-apart from said upper surface, and two lateral surfaces and two side surfaces all disposed between said upper and lower surfaces to form peripheral side walls of said dielectric block, said dielectric block comprising:

three resonators having a first through hole, a middle through hole, and a second through hole-formed in said dielectric block in a series and being perpendicular to said upper surface;

an outside conductor made of a conductive material coated on a peripheral portion of said upper surface, said lower surface, and said lateral and side surfaces;

first, middle, and second coated upper area coated with the conductive material formed on said upper surface, coated with the conductive material, disposed around respective through holes;

first, middle, and second non-coated upper area formed on said upper surface and disposed around said respective conductive upper areas;

non-coated input and output areas formed on one of said lateral surfaces and spaced apart from each other by a predetermined distance of said outside conductor coated between said non coated input and output areas, disposed on first and second positions of said one of said lateral surface each corresponding to said first and second through holes, respectively; and an input pad coated with the, conductive material disposed within said non-coated input area; and an output pad coated with the conductive material and disposed within said non-coated output area;

an expanded non-coated area formed on said one of said lateral surfaces at a middle position of said one lateral surface corresponding to said middle through hole disposed between said first and second through holes, extended from one of said non-coated input and output areas along said one of said lateral surfaces toward said middle position;

an extended pad coated with the conductive material, disposed within said expanded non coated area, and disposed on said middle position; and with said expanded non-coated area of said one of said lateral surfaces coupled to one of said first and second non-coated upper areas of said upper surface.

2. The dielectric filter of claim 1, with said expanded non-coated area of said lateral surfaces coupled to both one of said non-coated input and output areas and one of said first and second non-coated upper areas of said upper surface.

3. The dielectric filter of claim 1, with said expanded non-coated area of said lateral surfaces having a height greater than said extended pad.

4. The dielectric filter of claim 1, with said expanded non-coated area of said one of said lateral surfaces having a distance greater than a distance between first and middle through holes.

5. The dielectric filter of claim 1, with said expanded non-coated area of said one of said lateral surfaces having a height greater than said extended pad.

6. A dielectric filter, comprising:

a conductor adapted to be coupled between an input terminal and an output terminal, said conductor having a first node, a middle node, and a second node in a series, said middle node disposed between said first and second nodes;

first, middle, and second resonators adapted to be coupled to a ground terminal of an outer conductor, said resonators coupled to said first outside node, said middle node, and said second outside node of said conductor, respectively, in a series;

said input terminal and said output terminal formed on a lateral surface of a dielectric block of said dielectric filter and disposed a first position of said lateral surface corresponding to one of said first and second resonators and a second position of said lateral surface corresponding to said middle position, respectively;

an equivalent capacitor and an equivalent inductor both coupled between said first node and said no-middle node and between sad middle node and said second node;

a first capacitor coupled between said input terminal and said first node and between said output terminal and said second node; and a second capacitor coupled between one of said input terminal and said output terminal and said middle node, said second capacitor having a capacitance formed between said middle resonator and a notch pattern, said notch. Pattern disposed on a middle position of said lateral surface corresponding to said middle resonator, said notch pattern coupled on said one of said input and output terminals.

7. The dielectric filter of claim 6, with said middle resonator being spaced-apart from said first and second resonator.

8. The dielectric filter of claim 7, with said middle position being spaced-apart from said first and second position.

* * * * *